US007677990B2

(12) United States Patent
Ban

(10) Patent No.: US 7,677,990 B2
(45) Date of Patent: Mar. 16, 2010

(54) GOLF CLUB HEAD

(75) Inventor: Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 100 days.

(21) Appl. No.: 11/944,920

(22) Filed: Nov. 26, 2007

(65) Prior Publication Data

US 2008/0132352 A1 Jun. 5, 2008

(30) Foreign Application Priority Data

Nov. 30, 2006 (JP) ..... 2006-324552

(51) Int. Cl.
*A63B 53/04* (2006.01)

(52) U.S. Cl. ..... 473/331

(58) Field of Classification Search ..... 473/324–350, 473/287–292

See application file for complete search history.

(56) References Cited

U.S. PATENT DOCUMENTS

| | | | | |
|---|---|---|---|---|
| 1,289,553 | A | 12/1918 | Sanders | |
| 1,337,958 | A | 4/1920 | Reach | |
| 1,965,954 | A | 7/1934 | Davis | |
| 2,005,401 | A | 6/1935 | Storz | |
| D190,035 | S | 4/1961 | Hansen | |
| 3,693,978 | A | 9/1972 | East | |
| 4,067,572 | A | 1/1978 | Coleman | |
| 4,413,825 | A | 11/1983 | Sasse | |
| 4,753,440 | A | 6/1988 | Chorne | |
| 4,858,929 | A | 8/1989 | Long | |
| 4,957,294 | A | 9/1990 | Long | |
| 5,029,864 | A | 7/1991 | Keener | |
| 5,100,144 | A | 3/1992 | Okumoto et al. | |
| 5,437,088 | A | 8/1995 | Igarashi | |
| 5,591,092 | A | 1/1997 | Gilbert | |
| 5,637,044 | A * | 6/1997 | Swash | 473/331 |
| 5,688,186 | A | 11/1997 | Michaels et al. | |
| 5,709,616 | A | 1/1998 | Rife | |
| 5,744,780 | A | 4/1998 | Chang et al. | |
| 5,766,087 | A | 6/1998 | Kawamatsu | |
| 5,766,097 | A | 6/1998 | Horiuchi et al. | |
| 5,785,610 | A | 7/1998 | Birmingham | |
| 5,788,584 | A | 8/1998 | Parente et al. | |
| 6,733,400 | B2 | 5/2004 | Sherwood | |
| 6,814,673 | B2 | 11/2004 | Wahl et al. | |
| 6,849,004 | B2 | 2/2005 | Lindsay | |
| 6,981,923 | B2 | 1/2006 | Chappell | |
| 7,014,568 | B2 * | 3/2006 | Pelz | 473/287 |
| 7,056,226 | B2 | 6/2006 | Kennedy | |
| 7,066,833 | B2 | 6/2006 | Yamamoto | |

(Continued)

FOREIGN PATENT DOCUMENTS

| | | | |
|---|---|---|---|
| JP | 20026574 | A | 1/1990 |

(Continued)

*Primary Examiner*—Sebastiano Passaniti
(74) *Attorney, Agent, or Firm*—Paul, Hastings, Janofsky & Walker LLP

(57) ABSTRACT

A golf club head of this invention includes a face and a plurality of striations formed on the face by milling. A pitch P in the arrangement direction of the plurality of striations satisfies 300 μm≦P≦600 μm. The surface roughness of a region in the face with the striations satisfies in the maximum height of the profile Ry, 15 μm≦Ry≦0.005×P+15.7 μm.

4 Claims, 10 Drawing Sheets

U.S. PATENT DOCUMENTS

| | | | | |
|---|---|---|---|---|
| 7,156,751 | B2 | 1/2007 | Wahl et al. | |
| 7,159,292 | B2 | 1/2007 | Suzuki et al. | |
| 7,166,039 | B2 | 1/2007 | Hettinger et al. | |
| 7,179,175 | B2 | 2/2007 | Kennedy, III | |
| 7,192,361 | B2 | 3/2007 | Gilbert et al. | |
| 7,258,627 | B2 | 8/2007 | Chappell | |
| 7,275,999 | B2 | 10/2007 | Sherwood | |
| 7,285,057 | B2 | 10/2007 | Mann, Jr. et al. | |
| 7,327,017 | B2 | 2/2008 | Sirinorakul et al. | |
| 2002/0016218 | A1 | 2/2002 | Takeda | |
| 2002/0042306 | A1 | 4/2002 | Chappell | |
| 2002/0132683 | A1* | 9/2002 | Buchanan | 473/340 |
| 2003/0008724 | A1 | 1/2003 | Griffin | |
| 2004/0087387 | A1 | 5/2004 | Wahl et al. | |
| 2005/0037859 | A1 | 2/2005 | Gilbert et al. | |
| 2005/0075191 | A1 | 4/2005 | Bennett | |
| 2005/0130761 | A1 | 6/2005 | Vokey et al. | |
| 2005/0143187 | A1 | 6/2005 | Kennedy | |
| 2006/0003851 | A1 | 1/2006 | Chappell | |
| 2006/0154739 | A1 | 7/2006 | Mann, Jr. et al. | |
| 2006/0223648 | A1 | 10/2006 | Kennedy, III | |
| 2007/0010346 | A1 | 1/2007 | Gilbert et al. | |
| 2007/0149312 | A1 | 6/2007 | Gilbert | |
| 2008/0020859 | A1 | 1/2008 | Yamagishi et al. | |
| 2008/0032814 | A1 | 2/2008 | Ban | |
| 2008/0051212 | A1 | 2/2008 | Voges | |
| 2008/0102981 | A1 | 5/2008 | Nguyen | |
| 2008/0108453 | A1 | 5/2008 | Park et al. | |
| 2008/0125242 | A1 | 5/2008 | Ban | |
| 2008/0125243 | A1 | 5/2008 | Ban | |
| 2008/0132351 | A1 | 6/2008 | Ban et al. | |
| 2008/0167138 | A1 | 7/2008 | Ban et al. | |
| 2008/0242442 | A1 | 10/2008 | Gilbert et al. | |
| 2009/0011852 | A1 | 1/2009 | Solheim et al. | |
| 2009/0029797 | A1 | 1/2009 | Ban et al. | |
| 2009/0036228 | A1 | 2/2009 | Ban et al. | |
| 2009/0082129 | A1 | 3/2009 | Ban et al. | |

FOREIGN PATENT DOCUMENTS

| | | | |
|---|---|---|---|
| JP | 08-000777 | A | 1/1996 |
| JP | 08-229169 | A | 10/1996 |
| JP | 09-70457 | A | 3/1997 |
| JP | 09-192274 | | 7/1997 |
| JP | 09-253250 | A | 9/1997 |
| JP | 09-308714 | | 12/1997 |
| JP | 10-015116 | A | 1/1998 |
| JP | 10-179824 | | 7/1998 |
| JP | 10-248974 | | 9/1998 |
| JP | 2001170227 | A | 6/2001 |
| JP | 2001-178856 | A | 7/2001 |
| JP | 2002-224250 | A | 8/2002 |
| JP | 2002291949 | A1 | 10/2002 |
| JP | 2003-093560 | | 4/2003 |
| JP | 2002-126135 | A | 6/2005 |
| JP | 2005-169129 | A | 6/2005 |
| JP | 2005-287534 | | 10/2005 |
| JP | 2007202633 | A | 8/2007 |
| JP | 2008005994 | A | 1/2008 |
| JP | 2008-079969 | A | 4/2008 |
| JP | 09-308715 | | 8/2009 |
| WO | 0002627 | A1 | 1/2000 |
| WO | 0074799 | A1 | 12/2000 |
| WO | 0345507 | A1 | 6/2003 |
| WO | 0197924 | A1 | 12/2007 |

* cited by examiner

FIG. 5

| | SET PITCH (μm) | SET CUTTING DEPTH (μm) | CUTTING EDGE RADIUS (mm) | Ry (μm) | Ra (μm) | RULE CONFORMANCE | SPIN AMOUNT (rpm) |
|---|---|---|---|---|---|---|---|
| #1 | 400 | 15 | 1.34 | 13.2 | 3.6 | ○ | 5000 |
| #2 | | 17 | 1.20 | 16.6 | 4.3 | | 6500 |
| #3 | | 20 | 1.00 | 18.5 | 4.7 | × | 6800 |
| #4 | | 25 | 0.80 | 23.8 | 6.0 | | 7500 |
| #11 | 500 | 15 | 2.09 | 13.4 | 3.0 | ○ | 4000 |
| #12 | | 20 | 1.57 | 17.5 | 4.3 | | 6700 |
| #13 | | 25 | 1.25 | 22.3 | 5.8 | × | 9980 |
| #21 | 600 | 15 | 3.00 | 11.8 | 2.9 | ○ | 3500 |
| #22 | | 20 | 2.26 | 15.7 | 3.8 | | 6000 |
| #23 | | 25 | 1.81 | 19.0 | 4.7 | × | 6900 |

GOLF CLUB HEAD

BACKGROUND OF THE INVENTION

1. Field of the Invention

The present invention relates to a golf club head.

2. Description of the Related Art

In order to increase the spin amount of a ball and improve a hitting feel, golf club heads with the adjusted surface roughness of the face have been proposed. Japanese Patent No. 3000921 discloses a golf club head in which fine crossing grooves which are traces by a cutting tool are formed on the face. Japanese Patent Laid-Open No. 8-229169 discloses a putter head in which the face undergoes milling. Japanese Patent Laid-Open No. 2005-169129 discloses a golf club head in which the surface roughness of the face is set to 40 Ra or more.

Wedge golf club heads such as sand wedges and approach wedges are required of the large spin amount of a ball. Increasing the surface roughness of the face effectively increases the spin amount of the ball. However, when the surface roughness of the face is excessively large, the ball is easily damaged. In addition, the surface roughness of the face of a golf club head for official competitions is determined to be 4.57 μm or less in the arithmetic mean deviation of the profile (Ra) and 25 μm or less in the maximum height of the profile (Ry) by the rule. Therefore, in order to make a golf club head suitable for official competitions, the surface roughness of the face needs to be adjusted within the rule range.

SUMMARY OF THE INVENTION

It is an object of the present invention to provide a golf club head which is suitable for official competitions and capable of obtaining the larger spin amount of a ball.

According to the present invention, there is provided a golf club head including, a face, and a plurality of striations formed on the face by milling, wherein a pitch P in an arrangement direction of the plurality of striations satisfies 300 μm≦P≦600 μm, and a surface roughness of a region in the face with the striations satisfies in the maximum height of the profile Ry, 15 μm≦Ry≦0.005×P+15.7 μm.

In this golf club head, the striations are formed by milling. With this arrangement, as compared to a case wherein corrugations are formed on the face by shot blasting, the edges of the striations become sharper and the spin performance of the ball can be improved. When the pitch P in the arrangement direction of the plurality of striations and the surface roughness of the portion of the face with the striations fall within the respective ranges of the above-described values, the golf club head is suitable for official competitions and capable of obtaining the larger spin amount of the ball.

Further features of the present invention will become apparent from the following description of exemplary embodiments (with reference to the attached drawings).

BRIEF DESCRIPTION OF THE DRAWINGS

FIG. 5 is a table showing the specifications of the striations, rule conformance, and test results (spin amount) of golf club heads #1 to #4, #11 to #13, and #21 to #23;

DESCRIPTION OF THE EMBODIMENTS

Figure 1:
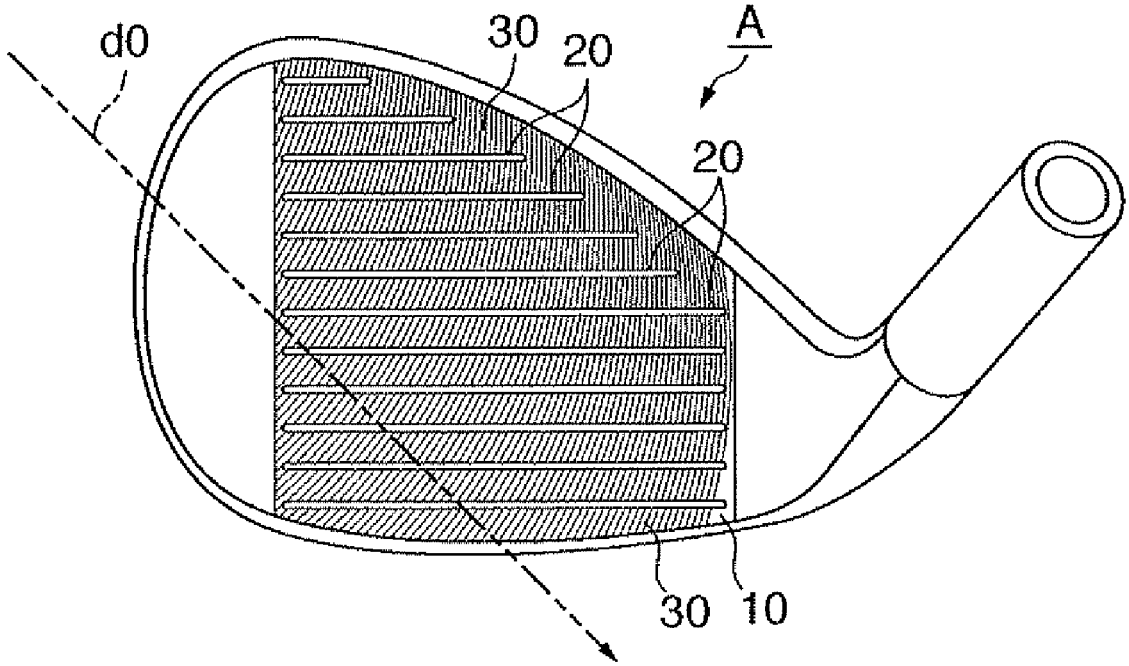
FIG. 1 is an external view of a golf club head A, according to an embodiment of the present invention.

FIG. 1 is an external view of a golf club head A, according to an embodiment of the present invention. The embodiment depicted in FIG. 1 applies the present invention to an iron club head. The present invention is optimized for club heads for which large spin amount is required, especially wedges such as sand wedges, pitching wedges, or approach wedges. The present invention may also be applied to golf club head for the wood type or the utility type.

The face 10 of the golf club head A comprises a plurality of the score line grooves 20. The face 10 is the surface that strikes the golf ball. According to the embodiment, the respective score line grooves 20 are arrayed in straight lines in the toe-heel direction, all in parallel, with equal pitch between the respective score line grooves 20. In the embodiment, the cross-section of each score line groove 20 is constant in the lengthwise direction, except at the ends. The score line grooves 20 have the same trapezoidal sectional shape.

A plurality of striations 30 are formed on the face 10 as traces (cutting marks) by milling. In the embodiment, each striation 30 forms a circular arc, and is shaped so as not to overlap any other striation 30. Also in the embodiment, each striation 30 is an arc of radius identical to every other striation 30.

An arrow d0 in FIG. 1 depicts an arrangement direction of the plurality of striations 30. In the embodiment, each striation 30 is an arc of radius identical to every other striation 30 as described above. The arrangement direction d0 is defined as the direction that passes through the center of the circle of arc of each striation 30.

Figure 2:
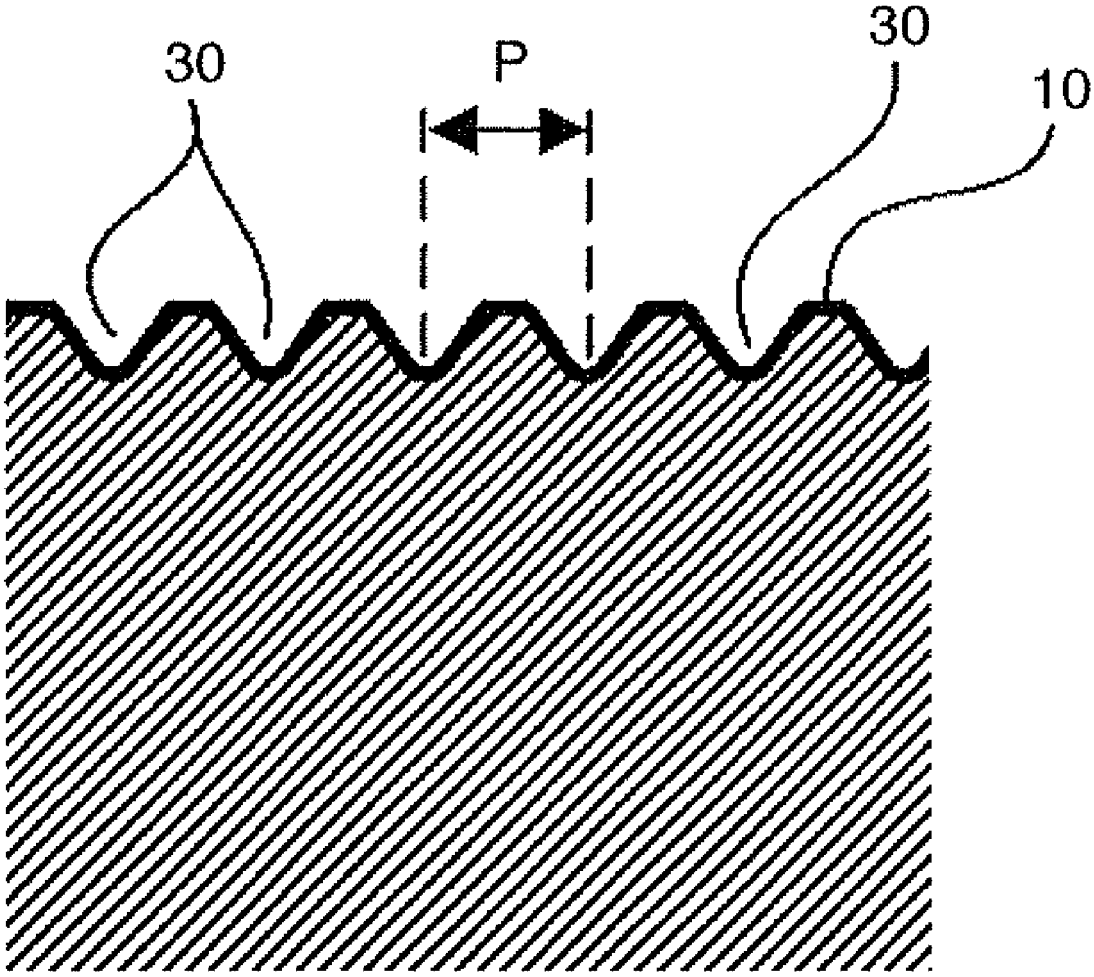
FIG. 2 is a partial cross-sectional view of the surface of the face 10 along an arrangement direction d0, and shows the sectional shape of striations 30.

FIG. 2 is a partial sectional view of the surface of the face 10 along the arrangement direction d0, and shows the sectional shape of the striations 30. A pitch P in the arrangement direction d0 of the plurality of the striations 30 represents a distance between the bottom surfaces of the adjacent striations 30, and is set to satisfy 300 μm≦P≦600 μm, and preferably 400 μm≦P≦500 μm. The surface roughness of the region in the face 10 with the striations 30 satisfies in the maximum height of the profile Ry, 15 μm≦Ry≦0.005×P+15.7 μm.

Figure 3:
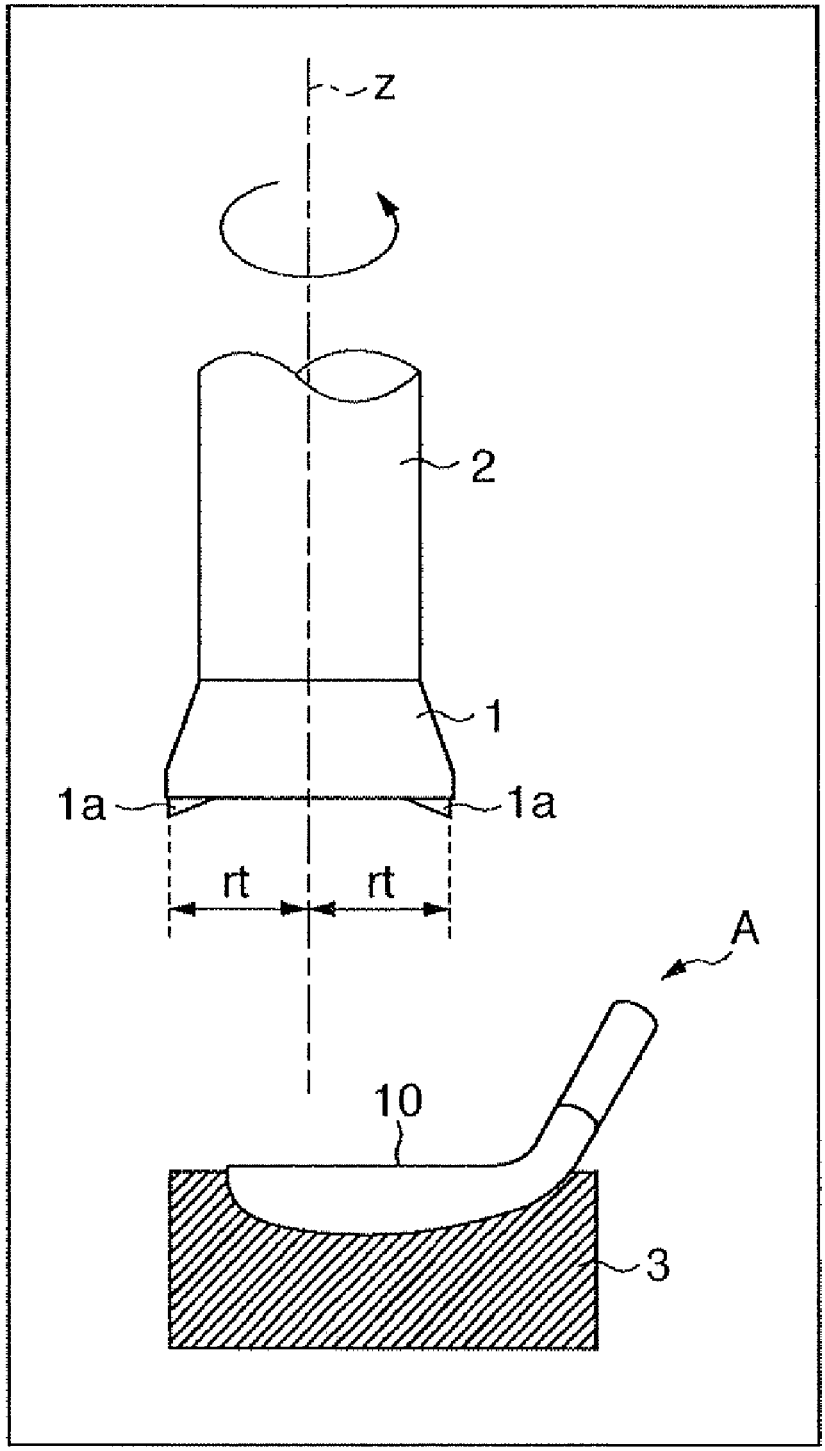
FIG. 3 shows views illustrating a forming method of the striations 30 using a milling machine.

The striations 30 can be formed as traces by milling. Milling can be performed using, e.g., a milling machine. FIG. 3 is a schematic diagram illustrative of a forming method of striations 30 using a milling machine. The milling machine comprises a spindle 2 that rotates about a vertical axis Z, and a cutting tool (endmill) 1 is attached to the lower end of the spindle 2. A golf club head A, that has not been formed with the striations 30, fixed with the milling machine by way of a jig 3 so that the face 10 is horizontal. A cutting portion 1*a* of the cutting tool is separated from the vertical axis Z by a distance rt, which is the radius of the circle of arc of each striation 30.

Figure 4:
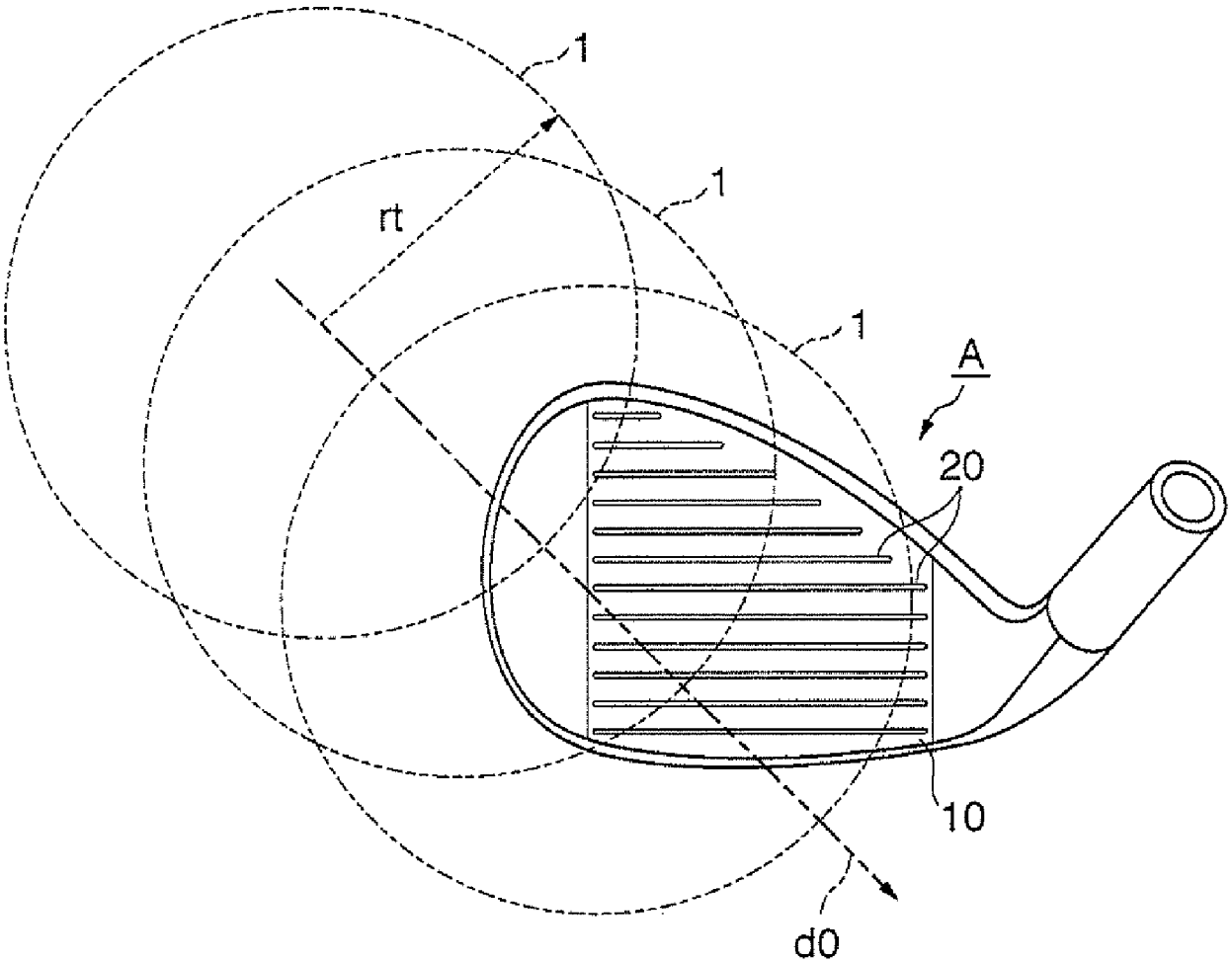
FIG. 4 is a plan view showing a moving path of a cutting tool 1 when milling the striations 30 by milling.

FIG. 4 is a planar view diagram illustrative of a moving path of the cutting tool 1 when milling the striations 30. The relative direction of movement, i.e., the horizontal direction, of the cutting tool 1 and the golf club head A, is identical with the arrangement direction d0 of the striations 30. As the cutting tool 1 is moved in the arrangement direction d0, relative to the golf club head A, the plurality of striations 30 is formed by milling the face 10 with the cutting tool 1. The center of the circle arc of each striation 30, or in other words, the position of the vertical axis Z, passes through the arrangement direction d0. Accordingly, the arrangement direction d0 is the direction that passes through the center of the circle arc of each striation 30. The depth, width, and pitch of each striation 30 is adjusted by the depth of the cut into the face 10 by the cutting tool 1 and the relative moving speed of the cutting tool 1.

In the golf club head A of this embodiment, the striations 30 are formed by milling. With this arrangement, as compared to a case wherein corrugations are formed on the face by shot blasting, the edges of the striations become sharper and the spin performance of the ball can be improved. When the pitch P in the arrangement direction of the plurality of striations and the surface roughness of the portion of the face with the striations fall within the respective ranges of the above-described values, the golf club head is suitable for official competitions and capable of obtaining the larger spin amount of the ball.

Figure 8:
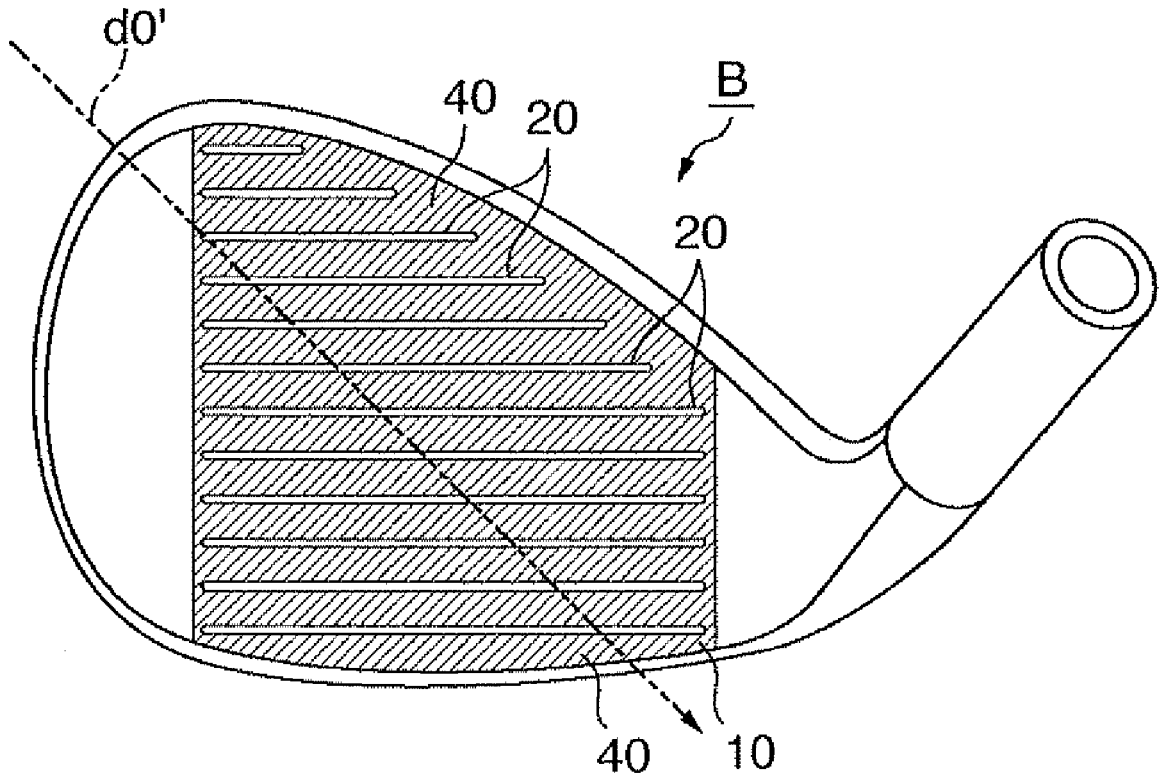
FIG. 8 is an external view of a golf club head B according to another embodiment of the present invention.

While each striation 30 has been formed as a circular arc according to the embodiment, it is possible to form the striations 30 as a straight line as well. FIG. 8 is an external view of an example of a golf club head B with striations in a different shape. The golf club head B is identical to the golf club head A, except for the fact that a plurality of striations 40 are formed of straight lines.

The plurality of striations 40 are mutually formed in parallel. When each striation 40 is straight lines, according to the embodiment, an arrangement direction d0' is defined as a direction that is orthogonal to each striation 40. In the golf club head B, a pitch P in the arrangement direction d0' of the plurality of the striations 40 is also set to satisfy 300 μm≦P≦600 μm, and preferably 400 μm≦P≦500 μm. The surface roughness of the region in the face 10 with the striations 40 satisfies in the maximum height of the profile Ry, 15 μm≦Ry≦0.005×P+15.7 μm.

Evaluation Test of Striation

A plurality of golf club heads having different specifications of the striations were fabricated, and the spin amount of the ball upon hitting the ball was measured for all the golf club heads. FIG. 5 is a table showing the specifications of the striations, rule conformance, and test results (spin amount) of golf club heads #1 to #4, #11 to #13, and #21 to #23.

All golf club heads are sand wedges with a loft angle of 56°. The circular arc striations 30 shown in FIG. 1 are formed on their faces. A cutting tool with a radius (rt in FIG. 3) of 37.5 mm was used to form the striations 30 by milling using a milling machine.

In FIG. 5, "set pitch" indicates a pitch in the arrangement direction d0 of the striations 30, which was set in the milling machine. "Set cutting depth" indicates the cutting depth of the cutting tool, which was set in the milling machine. The pitch P in the arrangement direction d0 of the striations 30 is considered to be formed to the "set pitch", and therefore was not actually measured.

"Cutting edge radius" indicates the radius of the cutting edge of the cutting tool. "Ry" represents the actual measurement value of the surface roughness (in the maximum height of the profile Ry) of the face with the striations 30, and "Ra" represents the actual measurement value of the surface roughness (in the arithmetic mean deviation of the profile: Ra) of the same. "Rule conformance" indicates whether the surface roughness of the face conforms to official competitions or not. Golf club heads #3, #4, #13, and #23 do not conform in terms of the arithmetic mean deviation of the profile: Ra.

The test was performed by hitting balls from rough to a target 30 yards ahead by five testers using the golf clubs mounted with the respective golf club heads. "Spin amount" in FIG. 5 indicates the average value of the spin amount on the ball. The spin amount is calculated by marking the ball prior to the shot, and using a video camera to track the change in the location of the mark at time of impact.

Figure 6A:
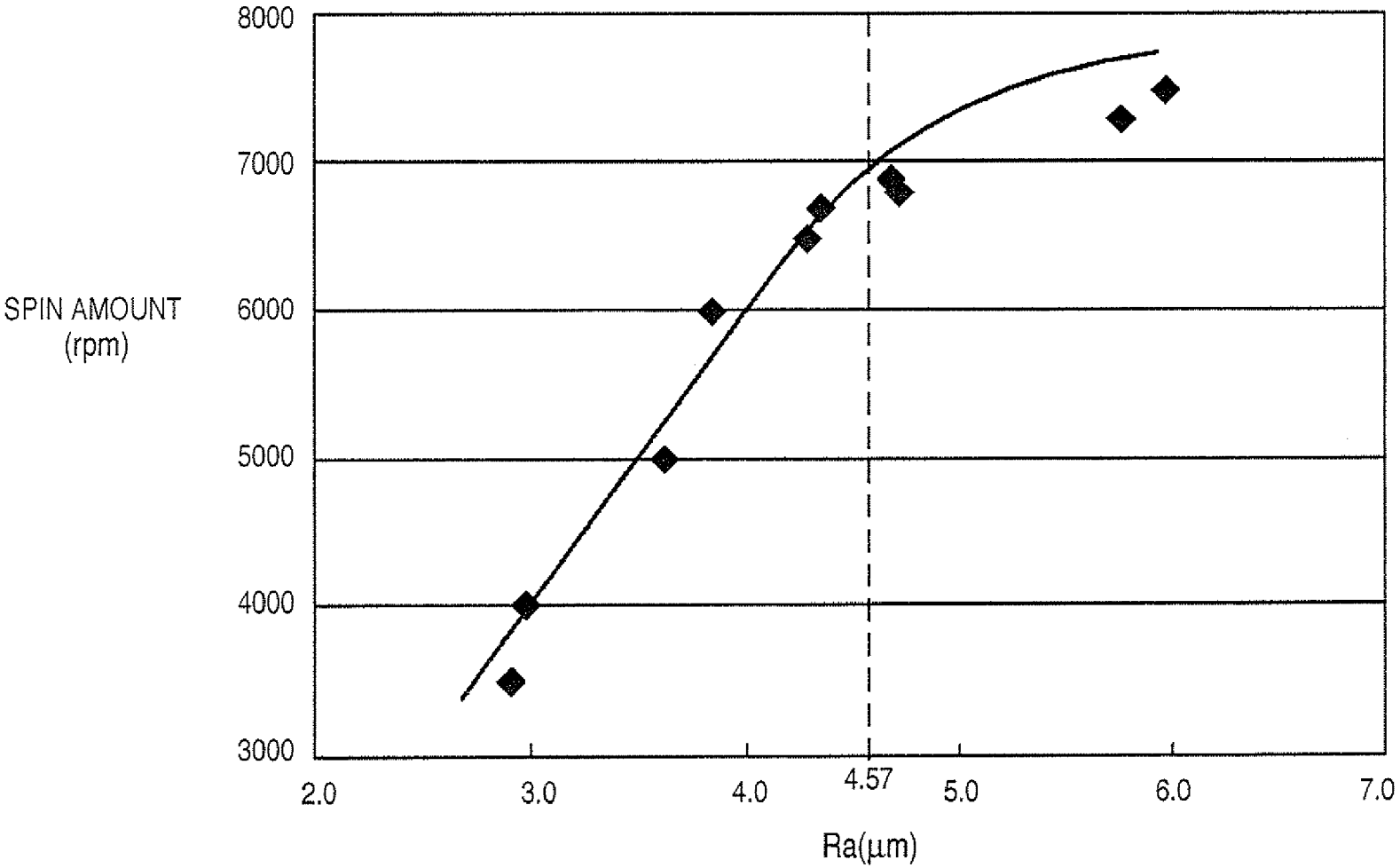
FIG. 6A is a graph showing the "spin amount"—"Ra" relationship of the test results shown in FIG. 5.
Figure 6B:
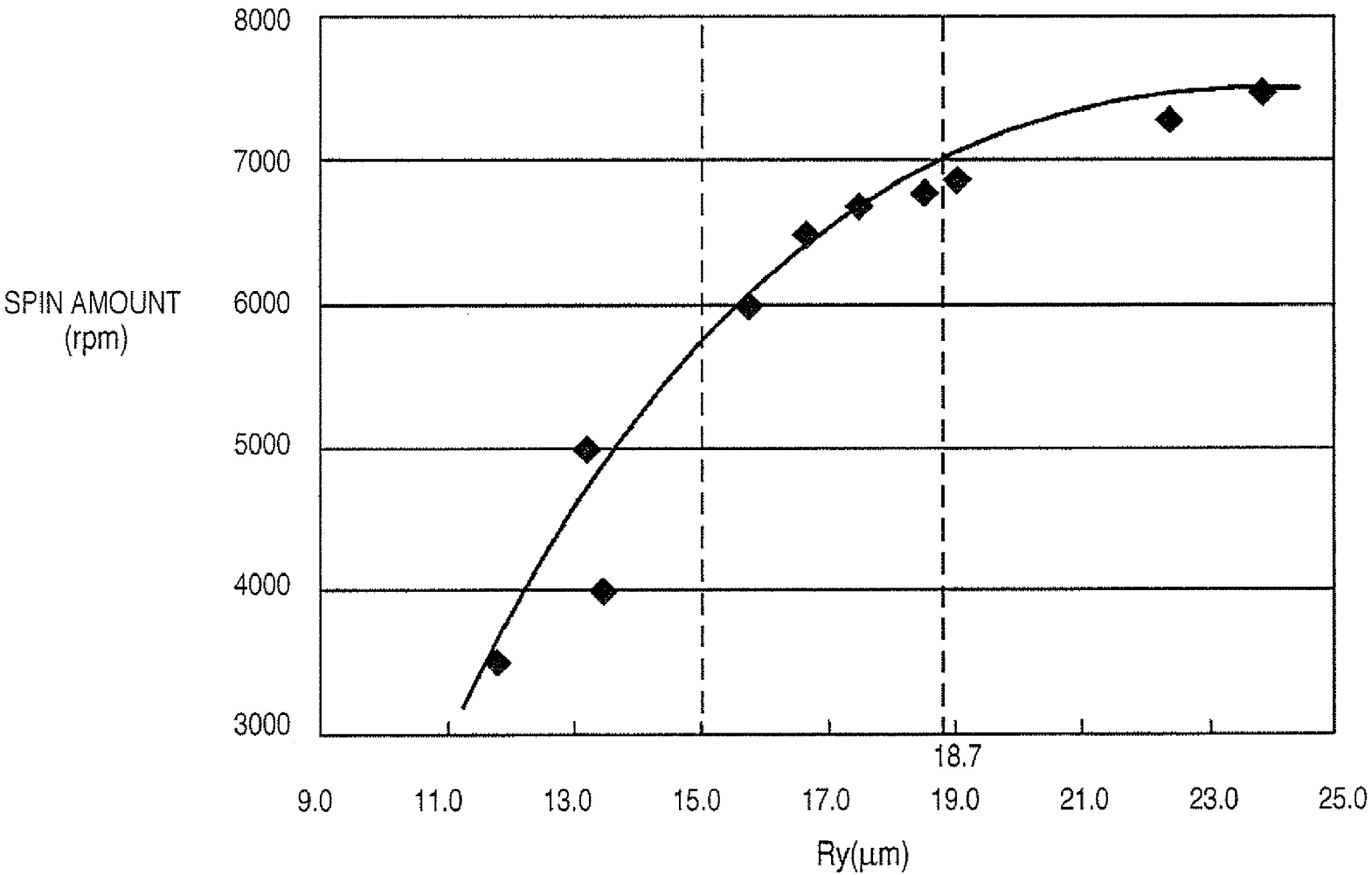
FIG. 6B is a graph showing the "spin amount"—"Ry" relationship of the test results shown in FIG. 5.

FIG. 6A is a graph showing the "spin amount"—"Ra" relationship of the test results in FIG. 5, and FIG. 6B is a graph showing the "spin amount"—"Ry" relationship of the test results in FIG. 5. These graphs show that the spin amount of the ball increases almost proportionately with "Ra" and "Ry".

Ra=4.57, which is represented by the broken line in FIG. 6A, indicates the maximum value of the surface roughness of the face of a golf club head for official competitions. When conformance to official competitions is considered, Ra must be 4.57 or less. The range of Ry falling between 15 and 18.7 (both inclusive), which is represented as the area between the broken lines in FIG. 6B, indicates the range of Ry obtained by the above-described equation (15 μm≦Ry≦0.005×P+15.7 μm) where the pitch P (set pitch) is 600 μm. Within this range, the spin amount of the ball of 6000 to 7000 rpm is obtained and, that is, the relatively large spin amount is obtained.

Figure 7A:
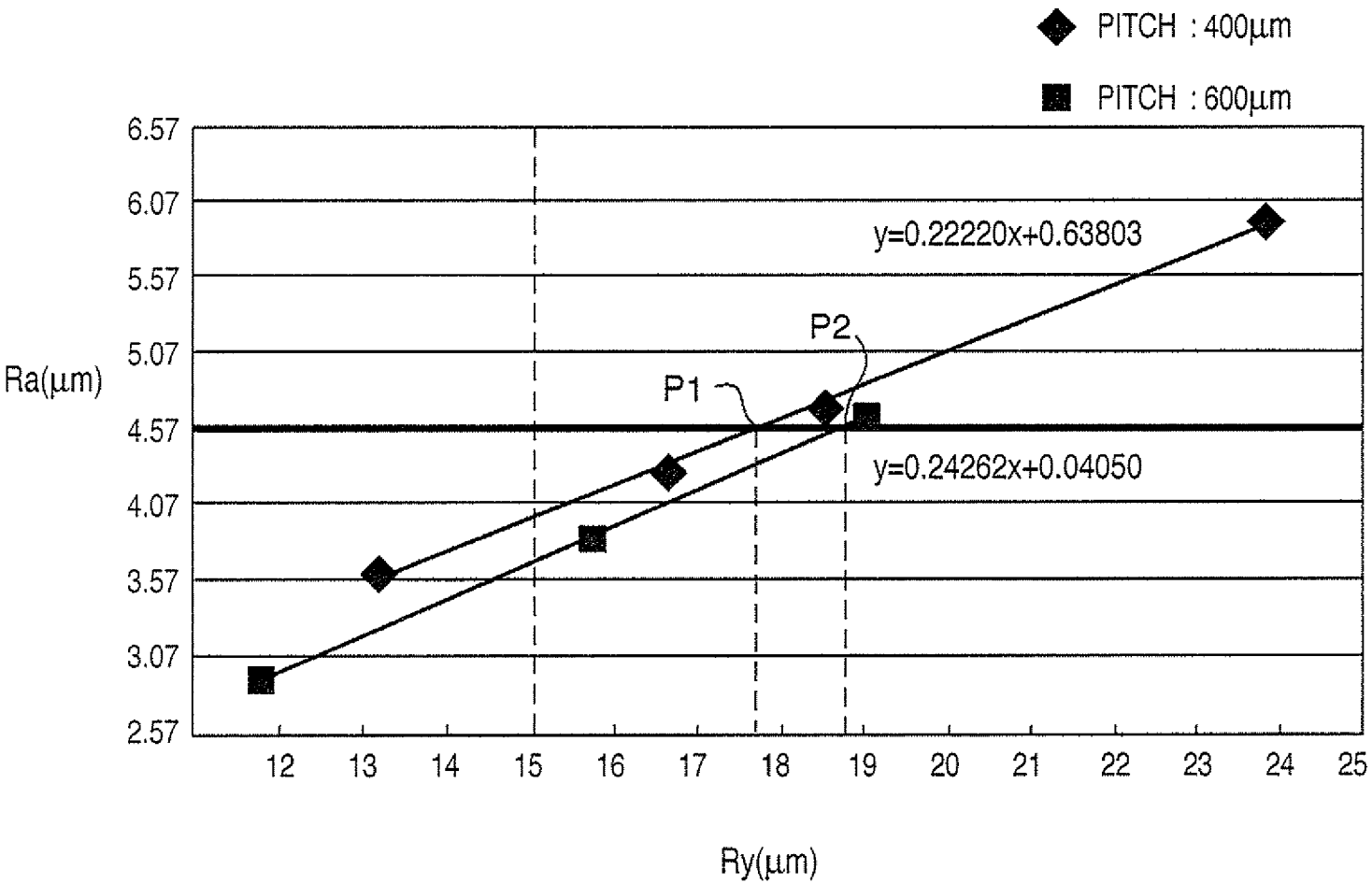
FIG. 7A is a graph showing the relationship between "Ra" and "Ry" shown in FIG. 5.

FIG. 7A is a graph showing the relationships between "Ra" and "Ry" shown in FIG. 5 for the pitch P (set pitch) of 400 μm and that of 600 μm. When "Ra" serves as a y-coordinate, "Ry" serves as an x-coordinate, and the relationships between "Ra" and "Ry" for the pitch P (set pitch) of 400 μm and that of 600 μm are approximated by linear equations, respectively, the relationship for the pitch P of 400 μm is expressed by y=0.22220x+0.63803, and that for the pitch P of 600 μm is expressed by y=0.24262x+0.04050. The slopes of the two lines are almost the same. That is, "Ra" and "Ry" are in a linear relationship, and "Ra" and the pitch P are also in a linear relationship.

Referring to the graph of FIG. 7A, when the pitch P remains unchanged, the surface roughness of the face increases as the cutting depth ("set cutting depth") of the striation 30 increases. Likewise, when "Ry" remains unchanged, "Ra" increases (the surface roughness of the face increases) as the pitch P decreases. In addition, when "Ra" remains unchanged, "Ry" can be increased (the cutting depth can be increased) as the pitch P increases.

As shown in FIG. 6B, the spin amount of the ball is almost proportional to "Ry". This means that when the depth of the striations 30 is large, more spin can be imparted to the ball. Referring to the test results shown in FIG. 6B, the "Ry" value is preferably 15 μm or more so that the spin amount of about 6000 rpm or more can be obtained.

When the upper limit value of "Ry" is determined based on "Ra"=4.57 μm as the maximum value of the surface roughness of the face of a golf club head for official competitions, the golf club head is suitable for official competitions and capable of obtaining the larger spin amount of the ball. Note that since "Ra" is also associated with the pitch P of the striations 30, the upper limit value of "Ry" is determined as follows.

Figure 7B:
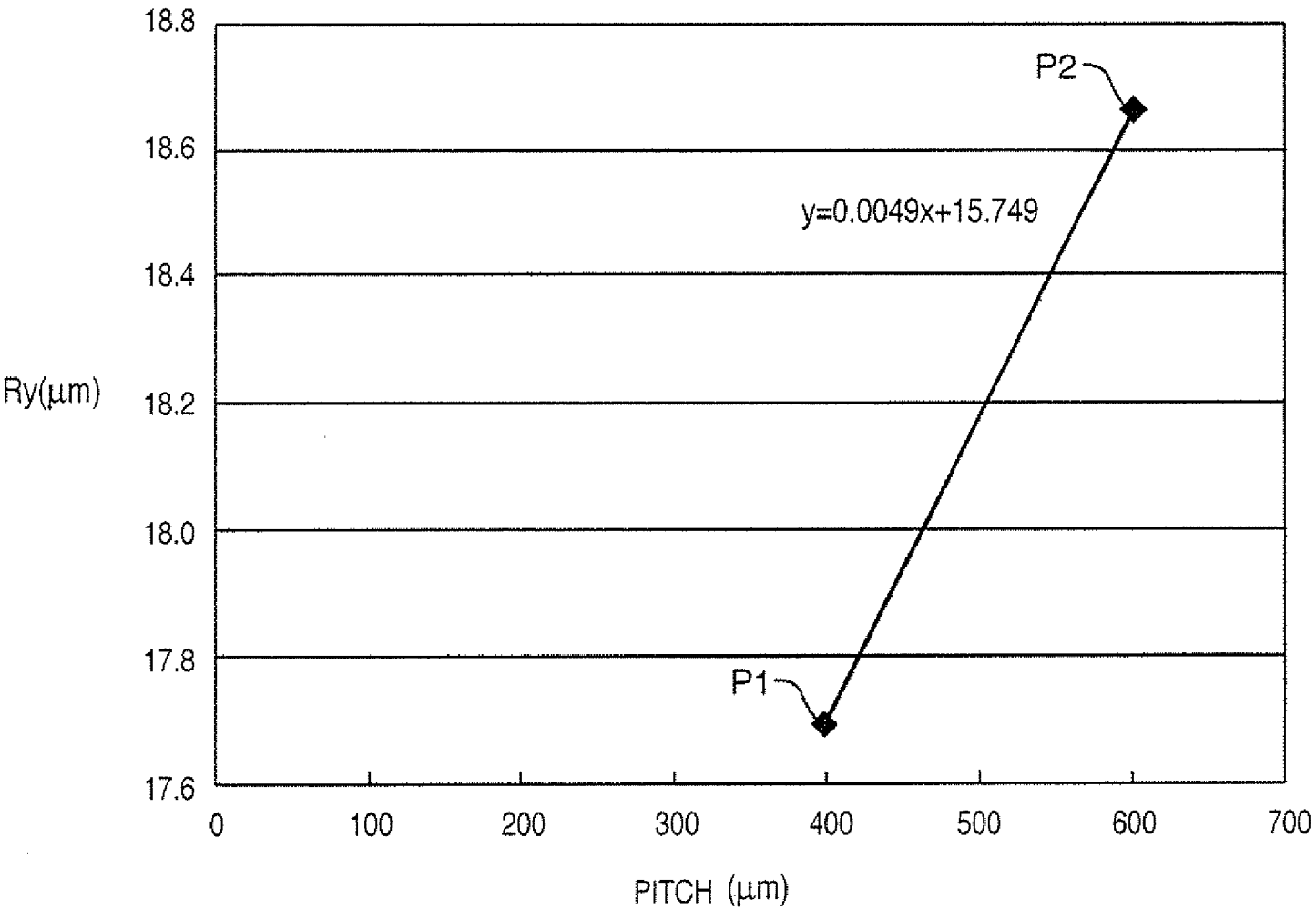
FIG. 7B is a graph showing the line (y=0.0049x+15.749) that passes through points P1 and P2 in an x-y coordinate system wherein "Ry" serves as an x-coordinate and a pitch P serves as a y-coordinate.

In FIG. 7A, points P1 and P2 at which y=4.57 (i.e., Ra=4.57 μm) respectively intersects the approximate line (y=0.22220x+0.63803) for the pitch P of 400 μm and that (y=0.24262x+0.04050) for the pitch P of 600 μm are determined. The line which passes through these points is calculated based on the relationship between "Ry" and the pitch P. FIG. 7B is a graph showing the line (y=0.0049x+15.749) which passes through points P1 and P2 in an x-y coordinate system wherein "Ry" serves as an x-coordinate and the pitch P serves as a y-coordinate.

The line (y=0.0049x+15.749) represents the upper limit values of "Ry" to satisfy "Ra"=4.57 μm in the relationship with the pitch P of the striations 30. Accordingly, the range of "Ry" is preferably set to satisfy 15 μm≦Ry≦0.005×P+15.7 μm.

As for the range of the pitch P of the striations 30, if the pitch P is too small, clogging occurs because dust such as grass easily clogs the striations 30, and therefore the spin performance cannot be ensured for a long time. If the pitch P is too large, improvement of the spin performance is small. Accordingly, the range of the pitch P in the arrangement direction of the striations 30 preferably satisfies 300 μm≦P≦600 μm, and more preferably 400 μm≦P≦500 μm.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-324552, filed Nov. 30, 2006, which is hereby incorporated by reference herein in its entirety.

What is claimed is:

1. A golf club head including:

a face;

a plurality of score line grooves formed on the face; and a plurality of striations formed on said face by milling, wherein a pitch P in an arrangement direction of said plurality of striations satisfies $$300\ \mu m \leqq P \leqq 600\ \mu m,$$

a surface roughness of a region in said face with said striations satisfies in a maximum height of profile Ry, where $$15\ \mu m \leqq Ry \leqq 0.005 \times P + 15.7\ \mu m,$$

said striations do not intersect with each other on said face, and each score line groove intersects with a plurality of said striations.

2. The golf club head according to claim 1, wherein the pitch P satisfies $$400\ \mu m \leqq P \leqq 500\ \mu m.$$

3. The golf club head according to claim 1, wherein each striation forms a circular arc, and said arrangement direction is a direction that intersects the center of the circular arc of each striation.

4. The golf club head according to claim 3, wherein a radius of each circular arc is the same.

* * * * *